US007661358B2

(12) United States Patent
Kim et al.

(10) Patent No.: US 7,661,358 B2
(45) Date of Patent: Feb. 16, 2010

(54) APPARATUS AND METHOD FOR FORMING PATTERN

(75) Inventors: Sang-Kyong Kim, Cheonan (KR); Sung-Won Choi, Suwon (KR); Jun-Young Son, Cheonan (KR); Jong-Kyong Kim, Jinhae (KR); Tae-Hyeon Lim, Ohsan (KR); Byong-Sik Kang, Suwon (KR); Ho-Chol Chae, Daegu (KR)

(73) Assignee: SFA Engineering Corp., Kyungsangnamdo (KR)

( * ) Notice: Subject to any disclaimer, the term of this patent is extended or adjusted under 35 U.S.C. 154(b) by 302 days.

(21) Appl. No.: 11/674,398

(22) Filed: Feb. 13, 2007

(65) Prior Publication Data

US 2007/0186791 A1 Aug. 16, 2007

(30) Foreign Application Priority Data

Feb. 14, 2006 (KR) ..... 10-2006-0014322

(51) Int. Cl.
*B41F 1/40* (2006.01)

(52) U.S. Cl. ..... 101/151; 101/153

(58) Field of Classification Search ..... 101/151, 101/153, 170

See application file for complete search history.

(56) References Cited

U.S. PATENT DOCUMENTS 5,367,953 A * 11/1994 Yamashita et al. ..... 101/158
7,148,090 B2 12/2006 Chapman
2006/0000378 A1 * 1/2006 Kubo ..... 101/477
2007/0037465 A1 * 2/2007 Nutz et al. ..... 442/376
2007/0095231 A1 * 5/2007 Van Denend ..... 101/375

* cited by examiner

*Primary Examiner*—Judy Nguyen
*Assistant Examiner*—Allister Primo
(74) *Attorney, Agent, or Firm*—Daly, Crowley, Mofford & Durkee, LLP

(57) ABSTRACT

The present invention relates to an apparatus and method for forming a predetermined pattern on a substrate using a gravure offset printing method. The apparatus for forming a pattern using a gravure offset printing method comprises a gravure on which a pattern to be filled with a color resist is formed; a roller brought into contact with the gravure to transfer the pattern formed on the gravure to the roller and then to print the transferred pattern onto a substrate; a roller driving means for rotating and horizontally driving the roller to transfer the pattern formed on the gravure to the roller and then to print the transferred pattern onto the substrate as it is; and a substrate support on which the substrate is placed. Further, the roller driving means includes a rotational driving unit for rotationally driving the roller; a horizontal driving unit for horizontally driving the roller independently of the rotational driving unit; and a control unit for controlling driving speeds of the rotational and horizontal driving units.

8 Claims, 5 Drawing Sheets

APPARATUS AND METHOD FOR FORMING PATTERN

BACKGROUND OF THE INVENTION

1. Claim For Priority

This application claims priority to Korean Patent Application No. 10-2006-0014322 filed on Feb. 14, 2006, in the Korean Intellectual Property Office (KIPO), the entire contents of which are hereby incorporated by reference.

2. Field of the Invention

The present invention relates to an apparatus and method for forming a predetermined pattern on a substrate using a gravure offset printing method.

3. Description of the Related Art

As various kinds of portable electronic equipment such as a mobile phone, person digital assistant (PDA) and notebook computer have been recently developed, a demand for a flat panel display having lightweight, thin and short and compact features is gradually increased. A flat panel display such as LCD (liquid crystal display), PDP (plasma display panel), FED (field emission display) and VFD (vacuum fluorescent display) have been actively studied and currently put to practical use.

In general, the flat panel display is formed with a color filter layer for implementing a color image thereon, and comprises a color filter in which a black matrix is formed to prevent an image quality thereof from being deteriorated due to leakage of light to a region excluding an image display area. A typical flat panel display including such a color filter is a liquid crystal display device. Such a liquid crystal display device is composed of a thin film transistor substrate with a thin film transistor formed thereon and a color filter substrate with a color filter layer formed thereon, and is completed by injecting liquid crystal between the two substrates to form a liquid crystal layer.

In the meantime, pixels having R (red), G (green) and B (blue) color components are generally arranged in a color filter layer 1, as shown in FIGS. 1 and 2. At this time, each of the pixels in the liquid crystal display device may be composed of sub-pixels with R, G and B color components. However, each pixel generally has a single color. The arrangement of pixels can be variously made according to the difference of resolution. Such a color filter layer can be formed through various methods such as dyeing, printing, electrodepositing and pigment spraying methods. In a conventional STN (super-twisted nematic) liquid crystal display device, the color filter layer has been mainly formed through the dyeing, printing or electrodepositing method. On the other hand, in a TFT LCD with excellent delicacy and reproducibility and applicability to a large-sized liquid crystal panel, the pigment spraying method is mainly utilized.

In the pigment spraying method, a photosensitive color resist is formed into a pattern through a typical photolithographic process to form the color filter layer. That is, the photosensitive color resist is first applied on a substrate, light is then irradiated onto the color resist using a mask, and a desired pattern is finally formed using developer, whereby the color filter layer has been completed. Therefore, the photolithographic process is required in forming the color filter through the pigment spraying method. However, there are some problems in that the photolithographic process is complicated and excessive manufacturing costs are required. Furthermore, the photolithographic process should be repeated three times to form the R, G and B pixels, and thus, a manufacturing process becomes more complicated.

In order to overcome the aforementioned problems in such a pigment spraying method, a scheme in which a printing method is employed in the TFT LCD field has been recently proposed. That is, a plurality of gravures, each filled with a color resist, and a plurality of rollers corresponding to the gravures are provided such that a color resist pattern with a certain color component is formed on a substrate by means of a roller, and the other color resists are sequentially formed by means of the other relevant rollers.

The above process will be described in more detail with reference to FIG. 3, as follow.

First, as shown in FIG. 3(*a*), an adequate amount of color resist R is supplied onto a surface of a gravure 10 on which a pattern of a predetermined color component is formed. At this time, an amount of the color resist R supplied onto the gravure is slightly greater than a volume of a pattern groove 12 formed on the surface of the gravure 10. Then, a doctor blade 20 is employed such that the color resist R is received only in the pattern groove 12 formed on the surface of the gravure 10, and the color resist remaining on the other region is removed.

After the color resist R has been filled as such, a roller 30 is rolled along the surface of the gravure 10 as shown in FIG. 3(*b*) such that the pattern of the color resist R formed on the surface of the gravure is transferred onto the roller.

Then, the roller 30 onto which the color resist pattern has been transferred is moved on a substrate 40, and the pattern of the color resist R transferred to the surface of the roller 30 is transferred again onto the substrate 40 as shown in FIG. 3(*c*). Consequently, a predetermined color resist pattern is formed on the substrate 40 in such a manner. The aforementioned process is repeated three times to form the R, G and B patterns on the substrate.

In order to manufacture the color filter in such a manner, the roller is rotated at a predetermined speed and moved in a horizontal direction. At this time, a rotating speed and a horizontally moving speed of the roller should be controlled precisely such that the color resist pattern formed on the roller can be transferred onto the substrate without any change.

As shown in FIG. 4, a roller 10 has been conventionally designed in such a manner that it is rotated and linearly moved using a pinion gear 14 and a rack 16. However, in a case where the pinion gear 14 and the rack 16 are utilized, there is a problem in that large noise is generated while the roller is driven. Further, there is another problem in that it is difficult to accurately control the roller due to tolerance and backlash by means of an error made in the process of machining the gear.

SUMMARY OF THE INVENTION

The present invention is conceived to solve the aforementioned problems in a prior art. Therefore, an object of the present invention is to provide an apparatus and method for forming a pattern by accurately controlling rotational and linear motions of a roller to form an accurate color resist pattern.

According to an aspect of the present invention for achieving the object, there is provided an apparatus for forming a pattern using a gravure offset printing method, which comprises a gravure on which a pattern to be filled with a color resist is formed; a roller brought into contact with the gravure to transfer the pattern formed on the gravure to the roller and then to print the transferred pattern onto a substrate; a roller driving means for rotating and horizontally driving the roller to transfer the pattern formed on the gravure to the roller and then to print the transferred pattern onto the substrate as it is; and a substrate support on which the substrate is placed, wherein the roller driving means includes a rotational driving unit for rotationally driving the roller, a horizontal driving unit for horizontally driving the roller independently of the rotational driving unit, and a control unit for controlling driving speeds of the rotational and horizontal driving units.

Preferably, the rotational driving unit is a servo motor and the horizontal driving unit is a linear motor. Therefore, both rotational and linear motions of the roller can be precisely controlled.

The apparatus of the present invention may further comprise a plate-shaped compensating member provided at a front end of a region of the substrate support where the substrate is placed, the compensating member being brought into contact with the roller to assist in initial acceleration of the roller before the roller comes into contact with the substrate. Therefore, a difference in patterns due to a difference in roller speeds can be overcome.

At this time, the compensating member may have a thickness which is equal to or smaller than that of the substrate. Therefore, the horizontal motion of the roller can be smoothly performed in the process of accelerating the roller.

Further, the compensating member may be made of an elastic material. Therefore, the compensating member cannot exert impact on the roller upon initial contact with the roller.

In addition, the compensating member may be made of a material with a coefficient of thermal expansion similar to that of the substrate. Therefore, the uniformity of pattern formed on the substrate can be enhanced.

Also, the apparatus of the present invention may further comprising a plate-shaped compensating member provided at a rear end of a region of the substrate support where the substrate is placed, the compensating member being brought into contact with the roller to assist in deceleration of the roller after the roller has been brought into contact with the substrate. Therefore, stable deceleration of the roller can be performed.

According to another aspect of the present invention, there is provided a method for forming a predetermined pattern on a substrate using a gravure offset printing method, which comprises the steps of 1) measuring a pattern formed on a gravure; 2) compensating a ratio between rotational and linear motions of a roller; 3) discharging a color resist onto a surface of the gravure; 4) bringing a doctor blade into contact with the surface of the gravure to fill the pattern of the gravure with the color resist; 5) bringing the roller into contact with the surface of the gravure to transfer the pattern formed on the gravure to the roller; and 6) driving rotationally and horizontally the roller to print the pattern formed on the roller onto the substrate in a state where the roller is brought into contact with the substrate.

At this time, the horizontal and rotational driving of the roller in step 6) is performed by means of separate driving means, respectively. Therefore, the roller can be accurately controlled.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE INVENTION

Hereinafter, a preferred embodiment of the present invention will be described in detail with reference to the accompanying drawings.

Figure 1:
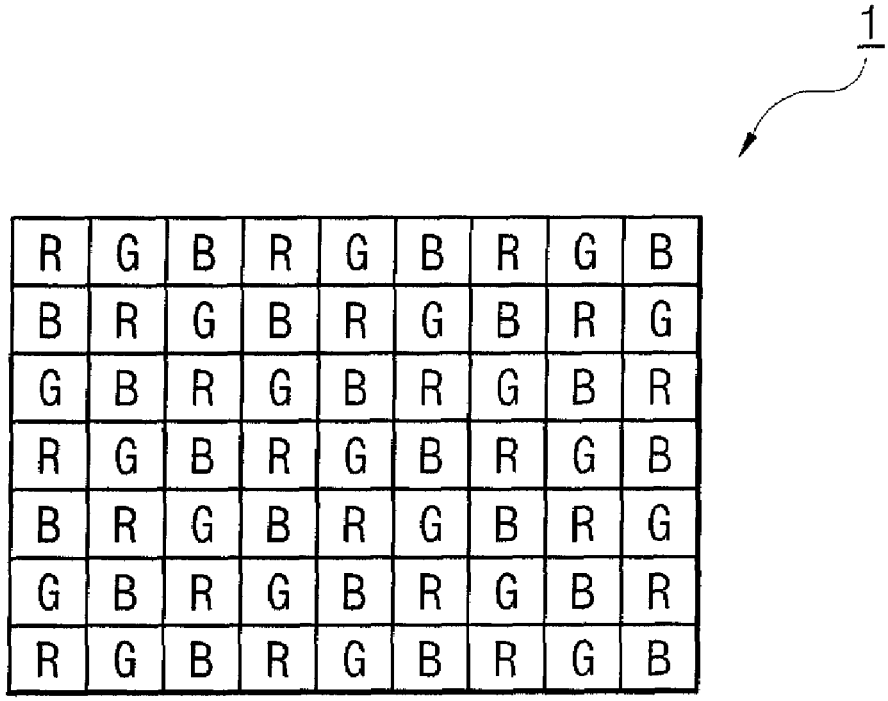
FIGS. 1 and 2 are plan views showing a structure of a color filter.
Figure 2:
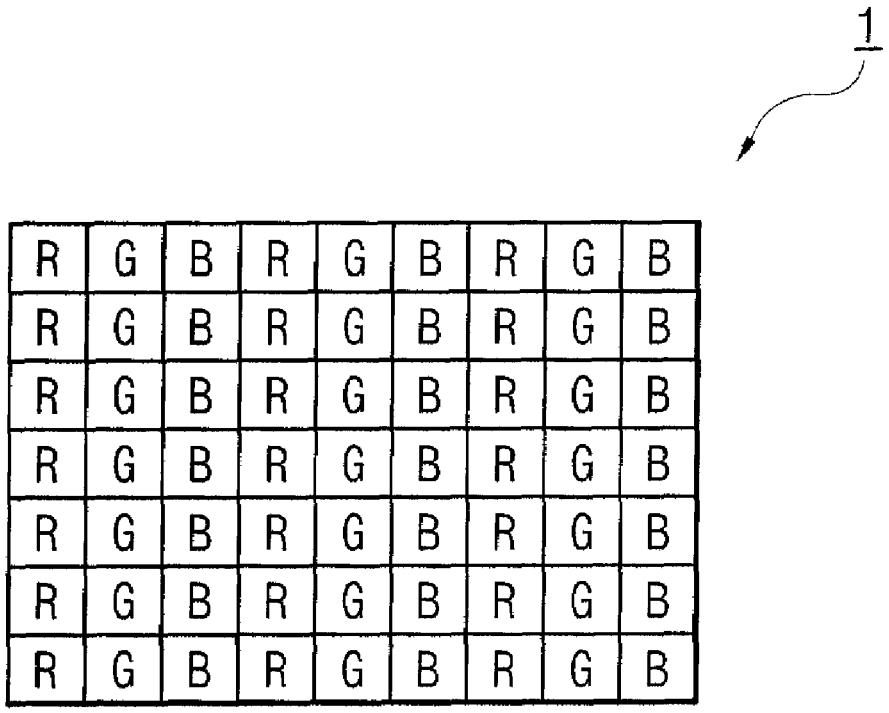
Figure 3:
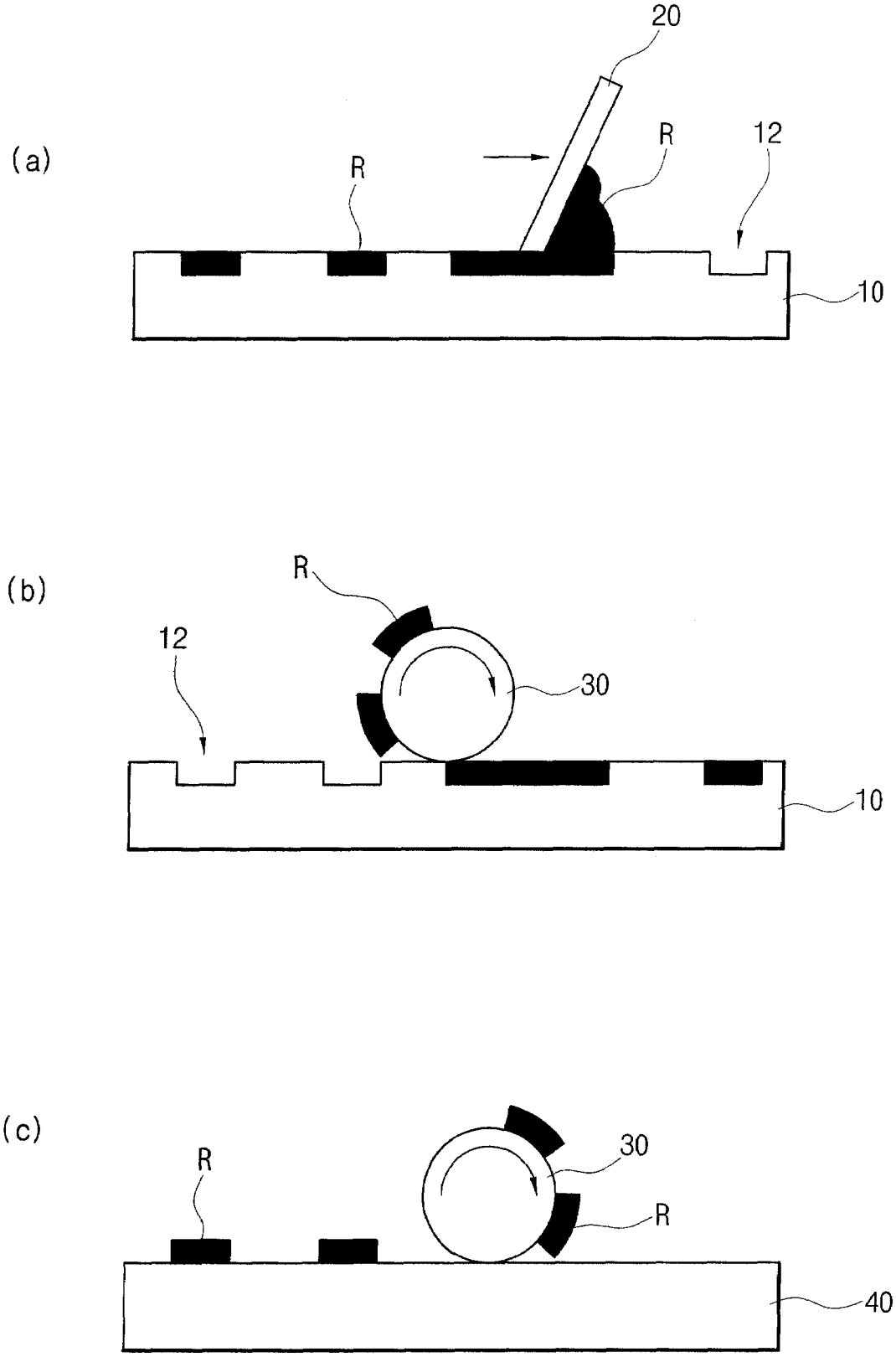
FIG. 3 is a view illustrating a conventional gravure offset printing process.
Figure 4:
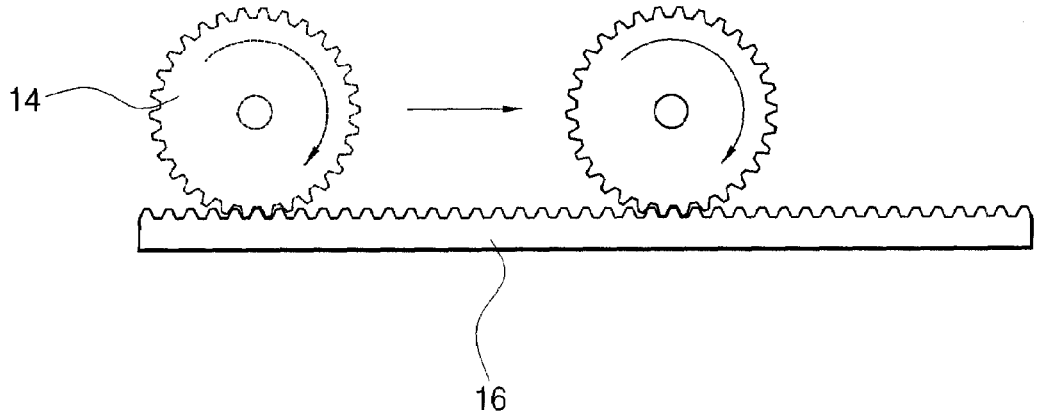
FIG. 4 is a view showing a structure of a conventional roller driving means.
Figure 5:
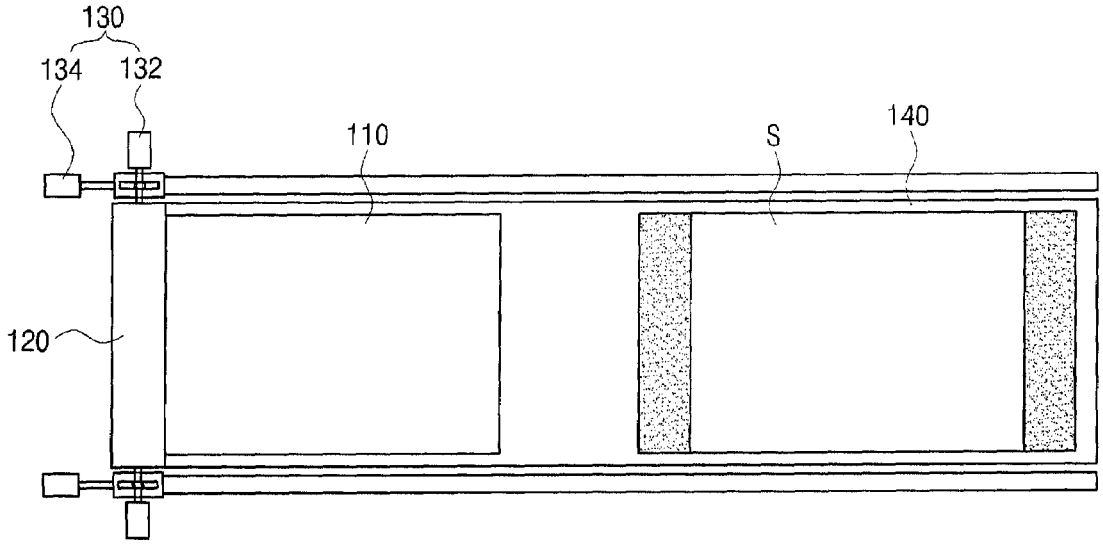
FIG. 5 is a plan view showing a structure of a pattern forming apparatus according to an embodiment of the present invention.
Figure 6:
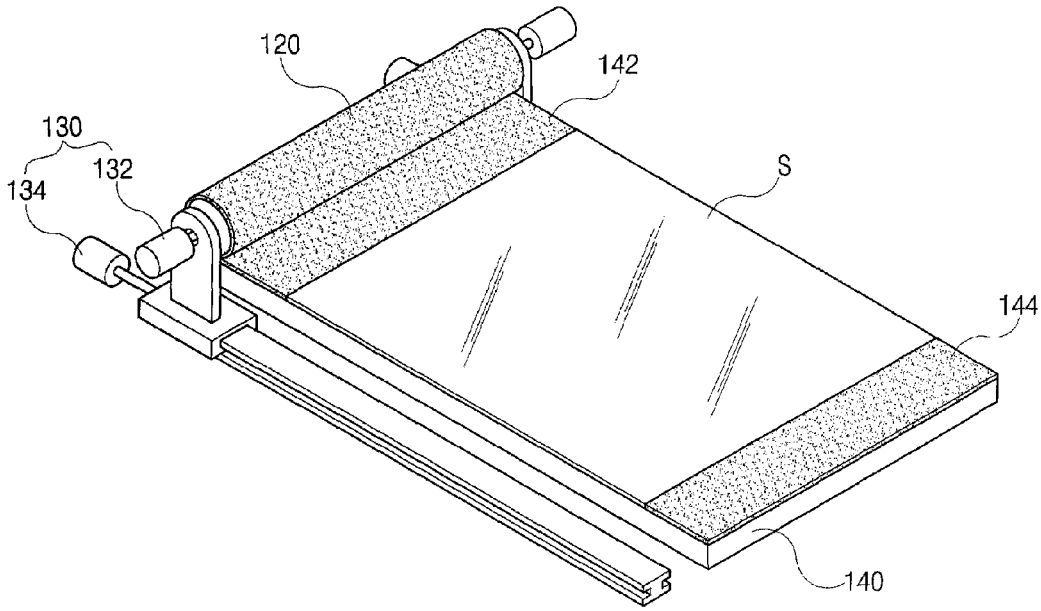
FIG. 6 is a perspective view showing a structure of a roller driving means according to an embodiment of the present invention.

As shown in FIG. 5, a pattern forming apparatus according to the present embodiment comprises a gravure 110, a roller 120, a roller driving means 130 and a substrate support 140.

First of all, the gravure 110 is a component with a pattern filled with a color resist being formed on a top surface thereof That is, an intaglio pattern having the same shape as a color resist pattern to be formed on a substrate is formed on a top surface of the gravure and is then filled with the color resist. The gravure 110 may be shaped into either a plate or a roll. The pattern is formed through a photolithographic method in the plate gravure, whereas the pattern is formed by means of a laser or electromagnetic manner in the roll gravure.

Next, the roller 120 is a component that comes into contact with the gravure 110 to allow a pattern formed on the gravure to be transferred thereto and the transferred pattern to be printed onto the substrate. In the pattern forming apparatus 100 according to the embodiment, the color resist pattern formed on the gravure 110 is transferred to the substrate as it is. The roller 120 serves to transfer the pattern formed on the gravure to the substrate.

Further, the roller driving means 130 is a component that drives rotationally and horizontally the roller 120 to allow the pattern formed on the gravure 110 to be transferred onto the roller and then the transferred pattern on the roller to be printed onto the substrate. That is, in order to transfer the color resist pattern formed on a plate onto a cylindrical surface of the roller, the roller driving means should drive the roller in such a manner that the roller is rotationally and linearly moved simultaneously. In the present embodiment, therefore, the roller driving means 130 is divided into a rotational driving unit 132, a horizontal driving unit 134 and a control unit. The rotational driving unit 132 is a component for rotationally driving the roller 120 and the horizontal driving unit 134 is a component for horizontally driving the roller 120. At this time, the rotational driving unit 132 and the horizontal driving unit 134 are independently driven. Further, the control unit is a component for controlling the diving speeds of the rotational driving unit 132 and the horizontal driving unit 134 and their ratio between the rotational and horizontal motions. In order to transfer the pattern formed on the gravure 110 onto a substrate S as it is, the ratio between the rotational and linear motions of the roller on the gravure should be maintained on the substrate. Therefore, the control unit controls the rotational driving unit and the horizontal driving unit in accordance with the proper driving ratio between the rotational driving unit and the horizontal driving unit, which is experientially obtained for accurately transferring the pattern.

Further, it is preferred in the present invention that a servo motor is used as the rotational driving unit 132 and a linear motor is used as the horizontal driving unit 134. Thus, the rotational and horizontal driving of the roller can be very accurately controlled.

Next, the substrate support 140 is a component on which the substrate S is placed. In a state where the substrate S is placed on the substrate support 140, the roller 120 is moved on the substrate and then rotationally and horizontally moved to transfer the color resist pattern onto the substrate.

Figure 7:
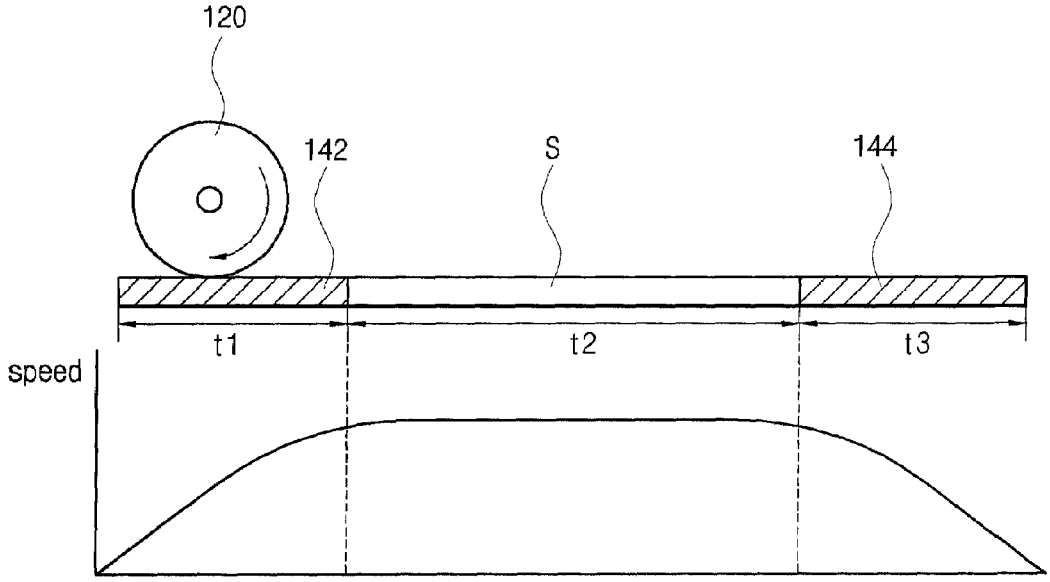
FIG. 7 is a view showing a roller driving speed in respective intervals according to an embodiment of the present invention.
Figure 8:
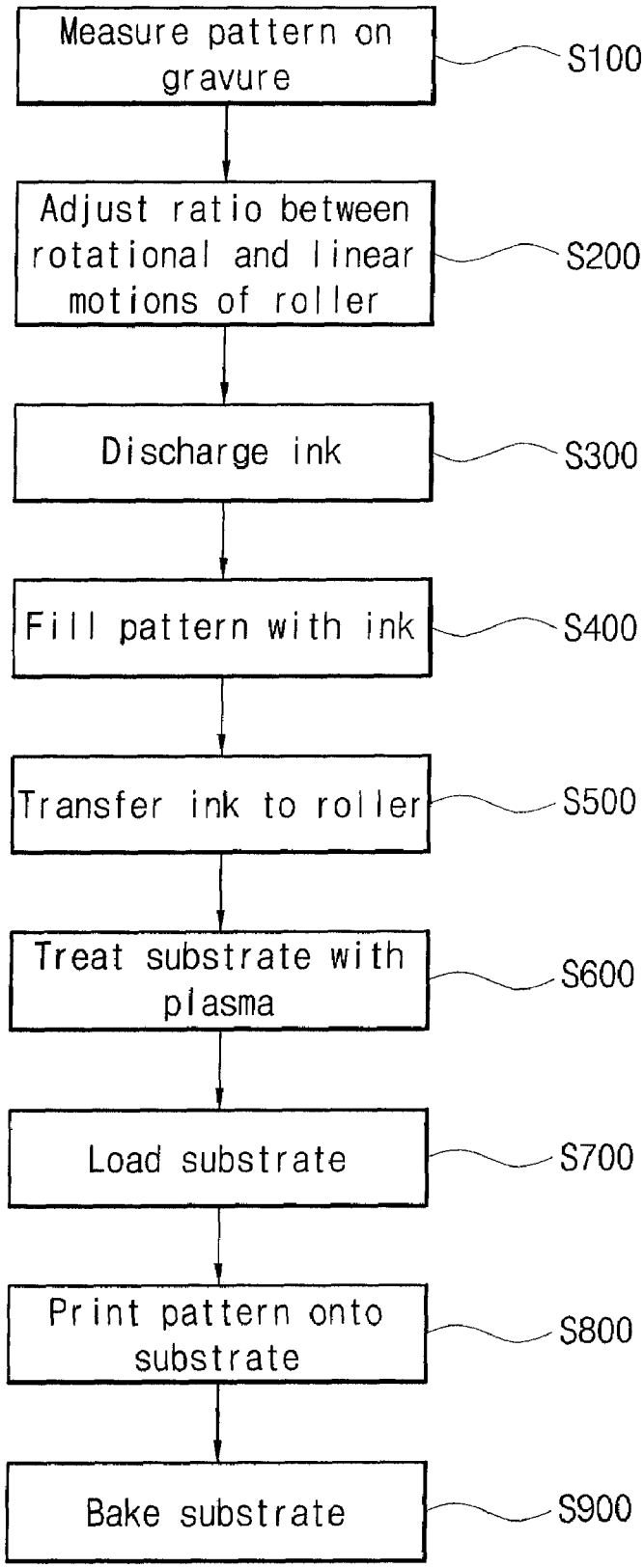
FIG. 8 is a view illustrating a process of forming a pattern according to an embodiment of the present invention.

In this embodiment, a plate-shaped compensating member 142 is further provided at a front end of a region of the substrate support 140 where the substrate is placed, and is brought into contact with the roller to assist in initial acceleration of the roller before the roller 120 comes into contact with the substrate S. In the pattern forming apparatus according to the embodiment, the roller 120 is rotationally and horizontally driven at the same time while a pattern is transferred from the gravure 110 onto the roller. However, after the pattern transfer from the gravure onto the roller has been completed, the roller is not rotationally driven but only horizontally driven while the roller is moved on the substrate. Then, when the roller reaches the substrate to start transferring the pattern onto the substrate, the roller is rotationally driven again. As shown in FIG. 7, if the roller 120 starts rotating at the front end of the substrate S, an accelerating interval t1 where a rotating speed of the roller is increased from 0 (zero) is created. In this accelerating interval t1, the rotating speed of the roller is not constant, and thus, there is a problem in that the uniformity of the pattern formed on the substrate is lowered. In this embodiment, therefore, the roller is accelerated to a constant rotating speed by means of the compensating member 142 such that the pattern can be transferred onto the substrate in a stable interval t2 where the roller is rotated at a constant speed. Therefore, the roller 120 according to this embodiment should be formed such that the circumference of the roller is longer than the entire length of the substrate by a length of the accelerating interval.

In addition, the compensating member 142 has a thickness which is equal to or smaller than that of the substrate S, so that no step (i.e., difference in height) is formed between the compensating member 142 and the substrate S. Consequently, the roller 120 can come into smooth contact with the substrate at a point where the roller is first brought into contact with the substrate. At this time, the compensating member 142 is preferably made of an elastic material such that the compensating member can absorb shock caused by the roller 120 when the roller comes into contact with the compensating member. The compensating member 142 is also preferably made of a material with a coefficient of thermal expansion similar to that of the substrate.

Furthermore, in order to stably decelerate the roller, another plate-shaped compensating member 144 is also preferably provided at a rear end of a region of the substrate support 140 where the substrate is placed. This compensating member 144 is brought into contact with the roller 120 to assist in deceleration of the roller after the roller has been brought into contact with the substrate S.

In addition, a plasma pretreatment unit is further provided in the pattern forming apparatus according to this embodiment. Since the pattern forming apparatus of the present invention is operated in such a manner that a color resist is printed onto a surface of the substrate, the color resist should adhere strictly to the surface of the substrate. However, a surface of the substrate may be stained with contaminants such organic materials, and thus, a contact force may be reduced due to a problem such as surface tension. Therefore, there is a problem in that adhesive strength of the color resist is lowered. In the present embodiment, therefore, the plasma pretreatment unit utilizing a plasma surface treatment method is used to completely remove foreign substances remaining on the surface of the substrate and to increase surface energy of the substrate surface, thereby increasing the contact force.

Hereinafter, a method of forming a pattern according to the embodiment will be described.

First, a step S100 of measuring the pattern formed on the gravure is performed. In the step S100, the pattern formed on the gravure, which corresponds to an original of the color resist pattern to be formed on the substrate, is accurately measured. On the basis of specific values measured as such, the control unit calculates a ratio between rotational and linear motions of the roller to control the motion of the roller.

Then, a step S200 of correcting the ratio between the rotational and linear motions of the roller in accordance with the pattern values of the gravure measured in the previous step S 100 is performed. In general, the value measured once in the previous step is continuously effective for a single gravure. However, if the gravure is replaced with new one, the ratio between the rotational and linear motions of the roller is newly corrected on the basis of the newly measured values.

A step S300 of discharging an adequate amount of color resist to the surface of the gravure is then performed. In the step S300, an amount of the color resist required for filling pattern grooves of the gravure with the color resist is discharged onto the surface of the gravure.

Then, a step S400 of evenly distributing the color resist discharged on the surface of the gravure to fill the gravure pattern with the color resist is performed. In the step S400, a doctor blade is used to allow the color resist remaining on the surface of the gravure to be filled into the pattern grooves and the rest of the color resist to be removed.

A step S500 of bringing the roller into contact with the surface of the gravure to transfer the pattern to the roller is then performed. In the step S500, the roller is rotationally and horizontally driven to transfer the color resist pattern formed on the surface of the gravure to an outer circumferential surface of the roller as it is.

In this embodiment, a step S600 of causing the substrate, on which the pattern will be formed, to be pretreated is carried out. In this step S600, contaminants such as organic materials remaining on the surface of the substrate are removed using plasma and surface energy of the substrate surface is increased to increase contact force. If a the substrate is surface treated by means of the plasma as described above, there is an advantage in that the color resist can be easily attached to the substrate in the next printing step S800, whereby the contact force can be increased. Since the plasma used herein is generally employed to modify the substrate surface, the detailed description thereof will be omitted herein.

Furthermore, a plurality of patterns each composed of various color resists are formed on a single substrate. Therefore, a process of repeatedly printing the patterns onto a single substrate is carried out. In such a case, the step S600 of causing the substrate surface to be pretreated is performed only before the substrate is subjected to an initial pattern printing process, but the above step is not performed during the other repeated pattern printing steps.

In addition, a step S700 of loading the substrate on the substrate support is performed.

Next, a step S800 of moving the roller toward the substrate and then transferring the pattern formed on the roller again to the substrate to print the pattern onto the substrate is performed. In the step S800, the roller is rotationally and horizontally driven to print the pattern transferred to an outer circumferential surface of the roller onto the substrate in a state where the roller is brought into contact with the substrate. The rotating speed and horizontal moving speed of the roller and the ratio between the rotational and linear motions of the roller are controlled at the same conditions as those in the step of transferring the pattern formed on the gravure surface to the roller.

Finally, a step S900 of baking the substrate to stabilize and fix the transferred pattern is performed.

In this embodiment, since the rotational and horizontal motions of the roller can be achieved by means of separate driving units in the step S500 of transferring the pattern to an outer circumferential surface of the roller or in the step S800 of transferring the pattern formed on the roller to the substrate, it is possible to perform the accurate control of the roller and the precise printing of the pattern onto the substrate.

According to the present invention, since rotational and horizontal motions of the roller can be accurately controlled, a pattern formed on a gravure can be precisely transferred to a substrate. Due to a high degree of accuracy in forming the pattern, the pattern can be accurately formed even on a large-sized substrate for short processing time.

Further, there is an advantage in that a pattern forming apparatus and method according to the present invention can be applied to various fields including the electrode printing in a plasma display panel as well as the manufacture of a color filter in a flat panel display.

Although the present invention has been illustrated and described in connection with the preferred embodiment, it can be understood that various modifications, changes and additions can be made thereto without departing from the scope and spirit of the present invention.

What is claimed is:

1. An apparatus for forming a pattern using a gravure offset printing method, comprising:

a gravure on which a pattern to be filled with a color resist is formed;

a roller brought into contact with the gravure to transfer the pattern formed on the gravure to the roller and then to print the transferred pattern onto a substrate;

a roller driving means for rotating and horizontally driving the roller to transfer the pattern formed on the gravure to the roller and then to print the transferred pattern onto the substrate as it is; and a substrate support on which the substrate is placed, wherein the roller driving means includes:

a rotational driving unit for rotationally driving the roller;

a horizontal driving unit for horizontally driving the roller independently of the rotational driving unit; and a control unit for controlling driving speeds of the rotational and horizontal driving units, wherein the apparatus further comprises a plate-shaped compensating member provided at a front end of a region of the substrate support where the substrate is placed, the compensating member being brought into contact with the roller to assist in initial acceleration of the roller before the roller comes into contact with the substrate.

2. The apparatus as claimed in claim 1, wherein the rotational driving unit is a servo motor.

3. The apparatus as claimed in claim 1, wherein the horizontal driving unit is a linear motor.

4. The apparatus as claimed in claim 1, wherein the compensating member has a thickness which is equal to or smaller than that of the substrate.

5. The apparatus as claimed in claim 1, wherein the compensating member is made of an elastic material.

6. The apparatus as claimed in claim 1, wherein the compensating member is made of a material with a coefficient of thermal expansion similar to that of the substrate.

7. An apparatus for forming a pattern using a gravure offset printing method, comprising:

a gravure on which a pattern to be filled with a color resist is formed;

a roller brought into contact with the gravure to transfer the pattern formed on the gravure to the roller and then to print the transferred pattern onto a substrate;

a roller driving means for rotating and horizontally driving the roller to transfer the pattern formed on the gravure to the roller and then to print the transferred pattern onto the substrate as it is;

a substrate support on which the substrate is placed, wherein the roller driving means includes:

a rotational driving unit for rotationally driving the roller;

a horizontal driving unit for horizontally driving the roller independently of the rotational driving unit; and a control unit for controlling driving speeds of the rotational and horizontal driving units; and a plate-shaped compensating member provided at a rear end of a region of the substrate support where the substrate is placed, the compensating member being brought into contact with the roller to assist in deceleration of the roller after the roller has been brought into contact with the substrate.

8. The apparatus as claimed in claim 1, further comprising a plasma pretreatment unit for causing a surface of the substrate to be pretreated with plasma.

* * * * *